United States Patent [19]

Minotti

[11] 4,374,479

[45] Feb. 22, 1983

[54] TORQUE TRANSFER DEVICE FOR WRENCH APPLICATIONS

[76] Inventor: Peter L. Minotti, Box 75, Easton, Pa. 18042

[21] Appl. No.: 215,155

[22] Filed: Dec. 11, 1980

[51] Int. Cl.[3] ..... B25B 17/00

[52] U.S. Cl. ..... 81/57.3

[58] Field of Search ..... 81/57.3, 57.29, 57.11, 81/57.12, 57.13, 57.14, 57.18, 125, 60–63.2

[56] References Cited

U.S. PATENT DOCUMENTS

| | | | |
|---|---|---|---|
| 1,270,263 | 6/1918 | Burnson | 81/61 |
| 1,871,857 | 8/1932 | Martois | 81/57.16 |
| 2,557,628 | 6/1951 | Becker | 81/125 |
| 2,830,479 | 4/1958 | Finn | 81/57.3 |
| 3,541,897 | 11/1970 | Horton | 81/57.18 |
| 4,287,795 | 9/1981 | Curtiss | 81/57.3 |

FOREIGN PATENT DOCUMENTS

| | | | |
|---|---|---|---|
| 2056348 | 3/1981 | United Kingdom | 81/57.3 |

*Primary Examiner*—James L. Jones, Jr.
*Attorney, Agent, or Firm*—Austin R. Miller

[57] ABSTRACT

A tool for transferring torque from a driving member to a workpiece comprises a plurality of serially engaging gears wherein a first gear of said plurality includes means for mating engagement with the driving member for rotation of the first gear thereby and a last gear of the plurality includes means for engaging the workpiece for rotation thereof by the last gear. The gears are rotatably mounted in a support frame. The last gear may include an arcuate segment hingedly connected to the remainder of the last gear and rotatable about the hinge connection between open and closed positions. The arcuate segment in the closed position completes a circular periphery of the last gear and in the open position provides a passageway for movement of the workpiece into the last gear interior.

12 Claims, 10 Drawing Figures

TORQUE TRANSFER DEVICE FOR WRENCH APPLICATIONS

BACKGROUND OF THE INVENTION

1. Field of the Invention

This invention relates to methods and apparatus for transferring torque from a driving member to a workpiece when the driving member is preferably a hand or machine driven screwdriver, wrench or the like.

2. Description of the Prior Art

Wrenches, screwdrivers and the like are known with the art being well developed. Various ratchet wrenches are known, presumably functioning successfully to prevent rotation of a workpiece counter to a desired direction in which the workpiece is rotated by action of the wrench, during periods when the wrench is not used to apply torque to the workpiece.

Typical ratchet wrenches are disclosed in U.S. Pat. Nos. 2,537,175; 2,539,861; 3,448,641; 3,635,654; 3,659,484; 3,724,298; 4,053,037 and 4,211,127. These devices all share a common shortcoming: none of these devices can apply torque to a nut or bolt confined in tight quarters. These wrench apparatus have somewhat bulky heads, rendering it impossible to apply torque to nuts and bolts which are difficult to reach with one's hands.

Also relevant to this invention is apparatus disclosed in U.S. Pat. No. 4,128,025 which provides a bolt starting device having a driving stud for starting or removing loose bolts. The U.S. Pat. No. 4,128,025 apparatus includes a ratchet device for driving the bolt in either direction.

SUMMARY OF THE INVENTION

This invention provides a tool, for transferring torque from a driving member to workpiece, comprising a plurality of serially engaging gears where a first gear of the plurality includes means for mating engagement with the driving member, for rotation of the first gear thereby, and a last gear of the plurality includes means for engaging the workpiece for rotation thereof by the last gear, with all gears rotatably mounted in a support frame. The mating engagement means of the first gear is adapted for mating with a drive stud of the type disclosed in the aforementioned 4,128,025 patent.

In one embodiment of the invention the last gear of the plurality includes an arcuate segment hingedly connected to the remainder of the gear. The segment is rotatable about an axis parallel to the gear axis of rotation at the hinge connection between open and closed positions. In the closed position the arcuate segment closes the circular periphery of the gear; in the open position the arcuate segment leaves a gap in the gear periphery for passage of the workpiece therethrough into engagement means at the gear center.

In another embodiment the tool for transferring torque from a driving member to a workpiece includes an odd numbered plurality of identical circular externally toothed serially engaging gears rotatable about parallel aligned axes. A first gear of the plurality includes a socket for mating engagement with the driving member for rotation of the first gear thereby. A last gear of the plurality includes means for engaging the workpiece for rotation thereof by the last gear and includes the aforementioned arcuate segment hingedly connected to the remainder of the last gear and rotatable about an axis parallel to the gear axis of rotation between open and closed positions. The gears include coaxial cylindrical shoulders extending outwardly from opposite sides thereof. The tool further includes a pair of side plates sandwiching the plurality of gears therebetween, where the plates include cylindrical recesses in mutually facing surfaces thereof. Mutually facing surfaces of the recesses define bearing surface which complementally receive outwardly facing circular surfaces of the gear shoulders, for running contact therewith during gear rotation. Connecting means connect the side plates together and urge the respective bearing surfaces against the outwardly facing surfaces of the gear shoulders.

Optionally provided are gripping means mounted on the side plates proximate the last gear. The optional gripping means may be pivotable about the mounting point between a position at which the gripping means grip the workpiece, when the workpiece is engaged with the last gear, and a position where the gripping means are remote from the workpiece when the workpiece is engaged by the last gear. The gripping means may comprise two members rotatable one with another about the point of connection with the side plates and adapted to spread apart and retain a workpiece therebetween by moving parallel to the gear axis of rotation when the workpiece is forced between the gripping means. When spread apart the members resiliently resist spreading and attempt to return to their respective positions from which they were so-spread; the resilient action serves to retain the workpiece in the grasp of the gripping means.

DESCRIPTION OF THE PREFERRED EMBODIMENTS

Figure 1:
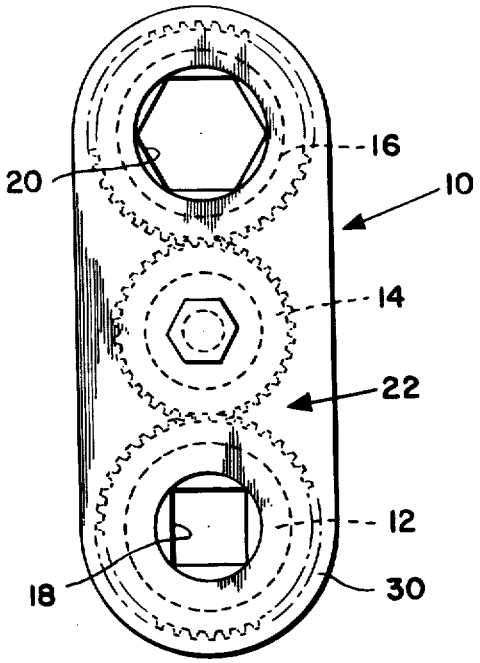
FIG. 1 is a front view of apparatus embodying the invention.
Figure 2:
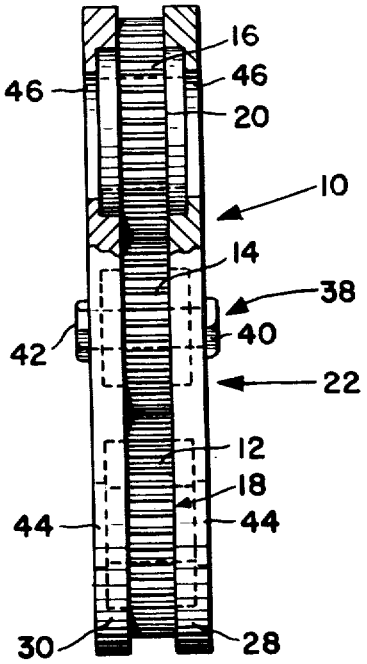
FIG. 2 is a side view of the apparatus depicted in FIG. 1.

The tool of the invention transfers torque from a driving member to a workpiece and is depicted in one embodiment in FIGS. 1 and 2 where the tool is designated generally 10. Tool 10 includes a plurality of serially engaging gears where the gears are denoted 12, 14 and 16. A first gear 12 includes a mating means adapted for mating engagement with a driving member for rotation of gear 12 by the driving member; the mating means is depicted in FIG. 1 as a square socket of the type which can receive a driving stud such as disclosed in U.S. Pat. No. 4,128,025. The square socket is denoted 18 in FIG. 1. Last gear 16 similarly includes engagement means for engaging a workpiece for rotation of the workpiece by last gear 16; the engagement means in FIG. 1 is illustrated as a hexagonal socket 20 in last gear 16. Serially engaging gears 12, 14 and 16 are rotatably mounted in a support frame generally designated 22 in FIGS. 1 and 2. Serial engagement of the gears results in rotation of all gears when any one of the gears of the plurality is rotated.

The plurality of gears is preferably an odd numbered plurality such as is illustrated in FIGS. 1 and 2 where three gears are provided. The gears are preferably identical circular externally toothed gears which are rotatable about parallel aligned axes as illustrated in FIGS. 1 and 2. With reference to FIG. 1 it will be noted that the axes of the rotation of the gears are aligned along a vertical line in FIG. 1; with reference to FIG. 2 it will be noted that the axes of rotation of the gears are parallel.

Figure 3:
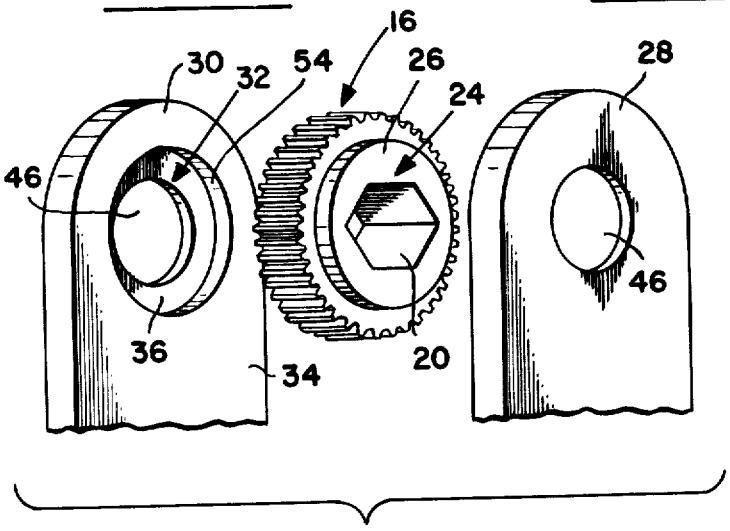
FIG. 3 is an exploded partial isometric view of one end of the apparatus depicted in FIGS. 1 and 2.
Figure 4:
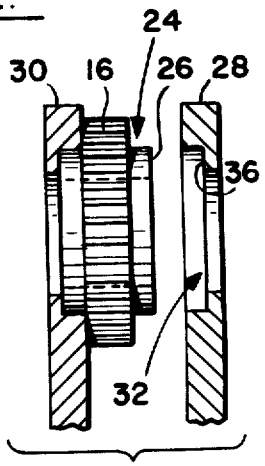
FIG. 4 is a broken exploded side view, partially in section, of one end of the apparatus illustrated in FIGS. 1 and 2.

Each of the gears preferably includes coaxial cylindrical shoulders 24 extending outwardly from opposite sides of the otherwise flat generally circular surfaces of the gears; one such shoulder is designated 24 in FIG. 3. An outwardly facing surface of the shoulder 26 defines a facing surface of the gear. Engagement means 20 in the form of the hexagonal socket extends entirely through shoulder 24 of gear 16.

Support frame 22 preferably includes a pair of side plates 28, 30 which sandwich gears 12, 14, 16 therebetween. Side plates 28, 30 include cylindrical recesses 32 in mutually facing surfaces 34 of plates 28, 30. Mutually facing surfaces 36 of recesses 32 are bearing surfaces which are journaled against respective outwardly facing surfaces 26 of the gear shoulders. Surfaces 36 and 26 are in running contact with each other during rotation of gears 12, 14, 16.

Side plates 28, 30 are connected together by connecting means 38 which may be in the form of a nut-bolt combination as depicted in FIG. 2. Connecting means 38 urge side plates 28, 30 towards one another and thereby urge respective facing bearing surfaces 36 against outwardly facing surfaces 26 of gears 12, 14, 16. As illustrated connecting means 38 may be a bolt 40 in threaded engagement with a nut 42. It is to be understood that corresponding recesses 32 are provided in both facing surfaces 34 of plates 28, 30 with corresponding recesses receiving oppositely facing shoulders 24 of a given gear 12, 14, 16.

At least one of side plates 28, 30 includes a passageway 44 aligned with the axis of rotation of first gear 12. Passageway 44 allows passage of a driving member therethrough into mating engagement with engagement means socket 18 of first gear 12. Preferably passageway 44 is provided in each of plates 28, 30. Also, at least one of side plates 28, 30 includes a passageway 46 aligned with the axis of rotation of last gear 16 for passage of a workpiece therethrough into engagement with workpiece engagement means socket 20 of last gear 16. Preferably, passageway 46 is provided in both plates 28, 30; this permits tool 10 to remain in engagement with the workpiece as the workpiece travels along a threaded shaft with the shaft passing through passageways 46 of side plates 28, 30 of tool 10.

It is preferable that as much of the outer extremities of gears 12, 14, 16 as possible inboard of and overlapped by edges of side plates 28, 30. This prevents fouling of the gears and prevents the gears from cutting the hand of the operator.

In one embodiment of the invention last gear 16 may include an arcuate segment 48 which is hingedly connected to the remainder portion 50 of last gear 16 at hinge connection 52. Hinge connection 52 preferably provides for rotation of arcuate segment 48 through an arc, with the axis of rotation being parallel to the axis of rotation of gear 16. Hinge connection 52 preferably is provided by a pin member passing through a tongue portion extending from arcuate segment 48 and through a hasp portion formed at one end of remainder portion 50.

Figure 5:
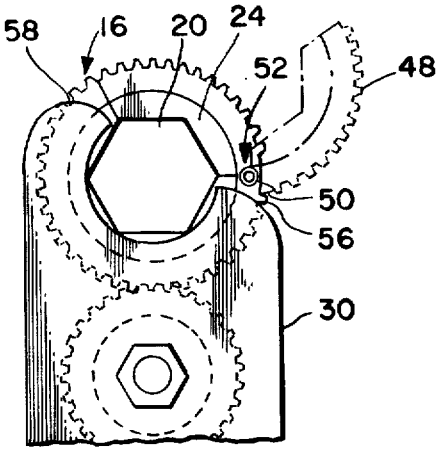
FIG. 5 is a broken view of apparatus manifesting a second embodiment of the invention; the end of the apparatus illustrated in FIG. 5 corresponds to that illustrated in FIGS. 3 and 4.

In FIG. 5 arcuate segment 48 is illustrated in solid lines in the closed position and is illustrated in phantom lines in the open position. In the closed position arcuate segment 48 completes and closes the circular periphery of last gear 16 while in the open position arcuate segment 48 leaves an arcuate gap in the otherwise closed circular periphery of gear 16. The gap permits passage of a workpiece laterally into engagement means socket 20 of last gear 16. In the embodiment illustrated in FIG. 5, the end shape of plate 30 has been modified to expose a portion of gear 16 outboard of the periphery of plate 30. This facilitates slidable receipt of the workpiece by engagement means 20 when arcuate segment 48 is in the open position. When a line is drawn connecting the axial extremities of side plate 30 on either side of hexagonal socket engagement means 20, the axis of rotation of gear 16 is inboard of the imaginary line, towards the central portion of the tool 10. This is necessary in order that gear 16 be retained within tool 10 by engagement of shoulders 24 of gear 20 with annular surface 54 of recess 32 in plates 28 and 30. Of course, with plates 28, 30 configured in the manner illustrated in FIG. 5, recesses 32 in plates 28, 30 receiving shoulder 24 of gear 16 are not entirely in the form of complete circles; the recesses are arcuate and subtend an angle slightly greater than 180° in order to retain gear 16 in position.

Figure 6:
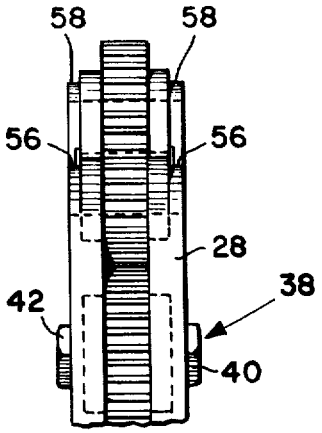
FIG. 6 is a view corresponding to FIG. 4 but not exploded, showing the embodiment illustrated in FIG. 5.

The axial extremities of plates 28, 30 are best shown in FIGS. 6 as tips 56, 58. Tip 56 is referred to as an intermediate tip while tip 58 is referred to as an extreme tip.

Figure 7:
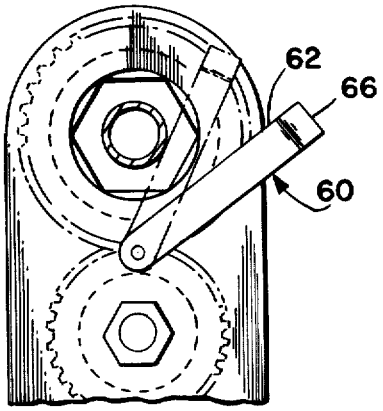
FIG. 7 is a view of an end portion of apparatus manifesting a portion of the invention.
Figure 8:
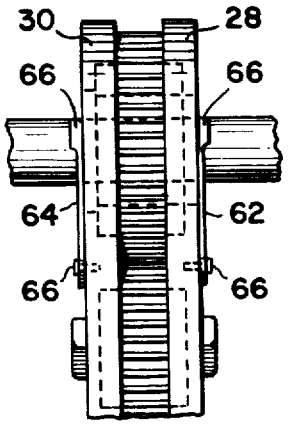
FIG. 8 is a side view of apparatus illustrated in FIG. 7.

Referring to FIG. 7 there is illustrated optional gripping means which may be provided with the tool for transferring torque. The gripping means is designated generally 60 and in the embodiment illustrated in FIGS. 7 and 8 includes two parallel resilient members 62, 64 each of which is secured to an external surface of respective side plates 28, 30 via pins 66. Members 62, 64 pivot about pins 66 and may be spread apart to retain a workpiece, such as a hexagonal nut, therebetween when the workpiece is forced between members 62, 64. Members 62 and 64 are preferably spring steel or resilient plastic so that members 62, 64 when spread apart resiliently resist such spreading and, by virtue of memory characteristic of the material, attempt to return to their original positions. Note that outer tips 66 of members 62, 64 are curved outwardly away from the external surfaces of plates 28, 30 to facilitate spreading of members 62, 64 as the members are forced over a workpiece. If desired, members 62, 64 can be connected by a strap around the outside of plates 28, 30 so that members 62, 64 move unitarily.

Figure 9:
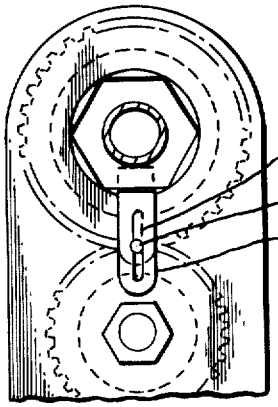
FIG. 9 is an end view of additional apparatus manifesting a portion of the invention.
Figure 10:
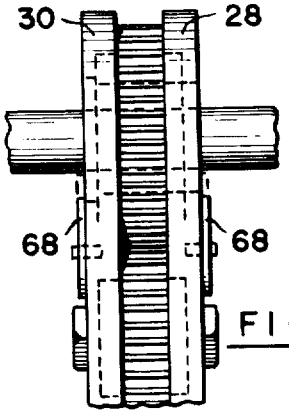
FIG. 10 is a side view of apparatus illustrated in FIG. 9.

FIGS. 9 and 10 illustrate yet another embodiment of gripping means for gripping a workpiece when the workpiece is engaged by gear 16. In the embodiment illustrated in FIGS. 9 and 10 the gripping means include two parallel shim-like members 68 slidable along external surfaces of plates 28 and 30 between positions at which shim-like members 68 do not overlie engagement socket 18 and positions at which shim-like members overlie engagement means socket 18 and hence may secure a hexagonal nut or bolt within last gear 16. The overlaying position of shim-like members 68 is illustrated in phantom lines in FIG. 9. Note that each shim-like member includes a central slot 70 extending substantially parallel to the direction of alignment of the axes of rotation of gears 12, 14 and 16 with a pin 74 having an enlarged head securing shim-like members 68 against plates 28 and 30.

The invention may be manufactured with last gear 16 either closed, as illustrated in FIG. 1, or with an arcuate section 48 hingedly connected to the remainder of the gear thereby to provide an open entrance to the central engaging interior 20 of gear 16. Also, side plates 28, 30 may have circular apertures therein corresponding to recesses 32, receiving shoulders 24 of gears 12, 14, 16. In such case shoulders 24 would be visible from exterior of the apparatus; such construction would reduce the weight and the size of the apparatus.

When using the embodiment illustrated in FIG. 5, visually discernible indicia may be provided on the exterior surfaces of plates 28, 30. These indicia include directional arrows indicating proper orientation of the tool and particularly of last gear 16 with respect to the workpiece, depending on which way the operator desires to rotate the workpiece. Desirably the operator will use the tool by rotating gear 16 in the direction such that hinge connection 52 leads arcuate segment 48 as gear 16 rotates. Such leading rotation, with clockwise rotation of gear 16 when gear 16 is oriented as depicted in FIG. 5, maintains arcuate segment 48 in the closed position thereby retaining the workpiece within engaging socket means 20 interior of gear 16. The operator can maintain such relationship between hinge connection 52 and arcuate segment 48 regardless of the direction he wishes to rotate the workpiece by merely selecting the proper orientation of tool 10. For example, if the operator desires to rotate gear 16 in the counter-clockwise direction, the operator merely rotates tool 10 180° from the orientation illustrated in FIG. 5 thereby shifting hinge connection 52 and arcuate segment 48 to such a position whereby counter-clockwise rotation of gear 16 hinge connection 52 continues to lead arcuate segment 48 around the circular path of gear travel.

Engagement means 18 and 20, which have been respectively illustrated as square and hexagonal sockets in first and last gears 12, 16, may be of any suitable configuration. Likewise, any number of gears may be used in the invention although it is desirable that an odd number of gears be utilized so that the last or driving gear, such as gear 16 (designated the driving gear because this gear drives the workpiece of interest) turns the same direction as the first or driven gear (designated at driven gear because this gear is driven by the operator) during tool operation. Likewise any suitable shape orifice may be provided in plates 28, 30 for passage of the driving member and workpiece into the interiors of first and last gears 12, 16 respectively.

While the invention has been disclosed as having the serially contacing members represented by engaging gears all of the same size, this is not necessary. Different sizes of gears may be utilized for the first or driven gear, the last or driving gear and for the intermediate or idler gear or gears. Size of the driver, driven and idler gears may vary depending on the particular application.

Moreover, while the invention has been disclosed as utilizing engaging gears to transfer torque, it is not necessary that gears be used. Any combination of gears and/or rubber wheels and/or plastic wheels and the like may be used; the rotatable members may be of any material and need not be toothed. The only requirement is that the members be in sufficient contact so that when one of the members is rotated, the remaining members rotate.

Furthermore, while the invention has been disclosed as utilizing sockets in the first and last rotatable members to receive a driving member and a workpiece respectively, any engagement means such as a stud which protrudes outwardly through the side plate or plates might be used in place of the sockets.

I claim:

1. A tool for transferring torque from a driving member to a workpiece comprising:

a. a odd numbered plurality of serially engaging identical gears rotatable about parallel axes, each of said gears including coaxial cylindrical shoulders extending outwardly from opposite sides thereof b. a first gear of said plurality including engagement passageway means matingly engageable with said driving member for rotation of said first gear thereby;

c. a last gear of said plurality including passageway means for engaging said workpiece for rotation thereof by said last gear;

d. side plates sandwiching said plurality of gears therebetween and including cylindrical recesses defining bearing surfaces in respective facing surfaces of said plates, said bearing surfaces being journaled against respective facing surfaces of said gears for running contact therewith during gear rotation, said recesses having depth less than thickness of said plates so that outwardly facing surfaces of said plates present smooth solid faces overlying all of said gears, said side plates having rounded ends overlying first and last gears of said plurality, said rounded ends being formed on radaii slightly larger than respective radaii of said first and last gears of said plurality, said rounded ends being tangent with straight sides of said plates so that teeth of all said gears are within an envelope defined by parallel peripheries of said side plates, said plates including openings overlying the centers of said first and last gears for passage therethrough of said driving member and said workpiece for respective engagement thereof with said first and last gears, said openings being formed to have respective inscribed circles of smaller radius than said respective cylindrical recesses for said shoulders of said first and last gears formed in said side plates but larger than respective inscribed circles of said passageways of said first and last gears; and e. means passing through the center gear of said odd numbered plurality for connecting said side plates together thereby urging said respective bearing surfaces against said facing surfaces of said gears.

2. A tool for transferring torque from a driving member to a workpiece comprising:

a. an odd numbered plurality of identical circular externally toothed serially engaging gears rotatable about parallel aligned axes, wherein i. a first gear of said plurality includes a socket for mating engagement with said driving member for rotation of said first gear thereby;

ii. a last gear of said plurality includes means for engaging said workpiece for rotation thereof by said last gear and includes an arcuate segment hingedly connected to the remainder of said last gear and rotatable, about an axis parallel said gear axis of rotation, at said hinge connection between open and closed positions, said arcuate segment in the closed position completing a circular periphery of said last gear and in the open position leaving a gap in the gear periphery for passage of said workpiece therethrough into said engagement means;

said gears including coaxial cylindrical shoulders extending outwardly from opposite sides thereof;

b. a pair of side plates sandwiching said plurality of gears therebetween, said plates including cylindrical recesses in mutually facing surfaces thereof, mutually facing surfaces of said recesses defining bearing surfaces journaled against respective outwardly facing surfaces of said gear shoulders other than said last gear for running contact therewith during gear rotation, said side plates at the ends thereof overlying said last gear having tip portions defining an open end of said tool, permitting said passageway means of said last gear to engage a axially elongated workpiece by movement of said tool into position, through said gap and between said respective tip portions of each of said side plates, around said workpiece in a direction perpendicular to the axis of rotation of said last gear so that said workpiece passes through space separating said tip portions of each of said side plates, said side plates in area of said tip portions having frusto-cylindrical recesses therein defining bearing surfaces journaled against respective outwardly facing circular surfaces of said shoulders of said last gear, openings in said side plates overlying said last gear and defining said open end of said tool having respective inscribed circles of radius smaller than said radius of said frusto-cylindrical recesses, for said shoulder of said last gear, formed in said side plates but larger than radius of said inscribed circle of said passageway through said last gear;

c. means passing through the center gear of said odd numbered plurality for connecting said side plates together and thereby urging said respective bearing surfaces against said outwardly facing surfaces of said gear shoulders;

d. gripping means mounted at an outboard surface of said side plates proximate said last gear, movable about said mounting point between a position at which said gripping means grips said workpiece when said workpiece is engaged with said last gear and a position at which said gripping means is remote from said workpiece and said last gear, said gripping means including:

i. two parallel resilient members secured to external surfaces of said side plates, said members being movable unitarily one with another about the point of connection with said side plates, said members being adapted to spread apart and retain a workpiece therebetween when said workpiece is forced between said gripping means, said members when spread apart resiliently resisting such spreading and attempting to return to their respective positions before being so-spread, ends of said resilient members remote from the position of connection to said side plates diverging outwardly from one another.

3. A tool for transfering torque from a driving member to a workpiece comprising:

a. a plurality of serially engaging gears including shoulders extending outwardly from sides thereof;

b. a first gear of said plurality including means engagable with said driving member for driving rotation of said first gear thereby;

c. a last gear of said plurality including passageway means extending therethrough, for engaging said workpiece for rotation thereof by said last gear;

d. plates sandwiching said plurality of gears therebetween and including bearing surfaces in facing surfaces of said plates, journaled against respective shoulders of said gears for running contact therewith during gear rotation, all of said gears but said last gear lying within an envelope defined by said plates, said plates at ends thereof overlying said last gear having respective separated tip portions defining an open end of said tool, permitting said passageway means of said last gear to engage an axially elongated workpiece by movement of said tool into position around said workpiece in a direction perpendicular to the axis of rotation of said last gear with said workpiece passing between said tip portions, at least one of said plates in the area of said tip portions having a recess therein journaled against said shoulder of said last gear, openings in said side plates defining said open end of said tool having respective inscribed circles of radius smaller than said radius of said bearing surface for said shoulder of said last gear formed in said side plates but larger than radius of said inscribed circle of said passageway through said last gear;

e. means for connecting said plates together thereby urging said bearing surfaces against said gears;

f. said last gear including an arcuate segment hingedly connected to the remainder of said last gear and rotatable about an axis parallel said gear axis of rotation at said hinged connection between open and closed positions, said arcuate segment in the closed position completing a circular periphery of said last gear and in the open position leaving a gap in the gear periphery for passage of said workpiece between said tip portions of said plates and through said gap into said passageway means of said last gear.

4. A tool for transfering torque from a driving member to a workpiece comprising:

a. an odd numbered plurality of serially engaging gears rotatable about parallel axes, each of said gears including coaxial cylindrical shoulders extending outwardly from opposite sides thereof;

b. a first gear of said plurality including engagement means coaxial therewith and matingly engageable with said driving member for driving rotation of said first gear thereby;

c. a last gear of said plurality including passageway means coaxial therewith and extending entirely therethrough, said passageway means having an inscribed circle of radius smaller than the cylindrical shoulder of said last gear, for engaging said workpiece for rotation thereof by said last gear;

d. side plates sandwiching said plurality of gears therebetween and including cylindrical recesses defining bearing surfaces in respective facing surfaces of said plates, said bearing surfaces being journaled against respective circular facing surfaces of said cylindrical shoulders of said gears other than said last gear for running contact therewith during gear rotation, said recesses having depth less than thickness of said plates so that outwardly facing surfaces of said plates present smooth faces overlying said gears other than said last gear, said sideplates having rounded ends overlying said first gear of said plurality, said rounded ends formed on a radius slightly larger than radius of said first gear of said plurality, said rounded ends being tangent to straight sides of said plates so that all of said gears but said last gear are within an envelope defined by parallel peripheries of said side plates, at least one of said plates including an opening overlying said first gear for passage therethrough of said driving member for engagement with said first gear, said side plates at the ends thereof overlying said last gear having tip portions defining an open end of said tool, permitting said passageway means of said last gear to engage an axially elongated workpiece by movement of said tool into position around said workpiece of said tool into position around said workpiece in a direction perpendicular to the axis of rotation of said last gear so that said workpiece passes through space separating said tip portions, said side plates in the areas of said tip portions having frusto-cylindrical recesses therein defining bearing surfaces journaled against respective outwardly facing circular surfaces of said shoulders of said last gear, openings in said side plates overlying said last gear and defining said open end of said tool having respective inscribed circles of radius smaller than radius of said frusto-cylindrical recesses for said shoulders of said last gear formed in said side plates but larger than radius of said inscribed circle of said passageway through said last gear; and e. means, passing through the center gear of said odd numbered plurality, for connecting said side plates together thereby urging said respective bearing surfaces against said facing surfaces of said gears;

f. said last gear including an arcuate segment hingedly connected to the remainder of said last gear and rotatable about an axis parallel said gear axis of rotation at said hinged connection between open and closed positions, said arcuate segment in the closed position completing a circular periphery of said last gear and in the open position leaving a gap in the gear periphery for passage of said workpiece between said tip portions of said side plates and through said gap into said passageway means of said last gear.

5. The tool of claim 3 or 4 wherein said arcuate segment defines an arc of less than 180°.

6. The tool of claim 5 wherein said passageway means portion of said last gear is a hexagonal socket and said arcuate segment subtends an angle of 120° with segment ends defined by bisectors of interior angles of said hexagonal socket so that two adjoining sides of said hexagon are defined by the interior of said arcuate segment.

7. The tool of claim 6 wherein said arcuate segment, when in the closed position, abuttingly contacts the remaining segment of said last gear with said abutting contact occurring remote said hinge means.

8. The tool of claim 7 wherein a line drawn between longitudinal extremities of said tips, on each of said respective plates, is outboard of the axis of rotation of said last gear.

9. The tool of claim 8 wherein frustro-cylindrical surfaces are formed as recesses in said plates receiving said last gear and define circular arcs exceeding 180°.

10. The tool of claim 9 wherein said circular arcs are less than 240°.

11. A tool for transfering torque from a driving member to a workpiece comprising:

a. a plurality of serially engaging rotatable gears including shoulders extending outwardly from sides thereof;

b. a first gear of said plurality including means engagable with said driving member for driving rotation of said first gear thereby;

c. a last gear of said plurality including hexagonal passageway means extending therethrough, for engaging said workpiece for rotation thereof by said last gear;

d. stationary plates sandwiching said plurality of gears therebetween and including bearing surfaces in facing surfaces of said plates, journaled against respective shoulders of said gears for running contact therewith during gear rotation, all of said gears but said last lying within an envelope defined by said plates, said plates at ends thereof overlying said last gear having respective separated tip portions defining an open end of said tool, permitting said hexagonal passageway means of said last gear to engage an axially elongated workpiece by movement of said tool into position around said workpiece in a direction perpendicular to the axis of rotation of said last gear with said workpiece passing between said tip portions, at least one of said plates in the area of said tip portions having a recess therein journaled against said shoulder of said last gear, wherein an imaginary line drawn between said tip portions said plate is outboard of the axis of rotation of said last gear, openings in said side plates defining said open end of said tool having respective inscribed circles of radius smaller than said radius of said bearing surface for said shoulder of said last gear formed in said side plates but larger than radius of said inscribed circle of said hexagonal passageway through said last gear said centers of said inscribed circles being inboard of said imaginary line and coincident with the axis of rotation of said last gear;

e. Means for connecting said plates together thereby urging said bearing surfaces against said said bearing surfaces against said gears;

f. said last gear including an arcuate segment subtending an arc of 120° with segment ends defined by bisections of interior angles of said hexagonal passageway so that two adjoining sides of said hexagon are defined by the interiors of said arcuate segment hingedly connected to the remainder of said last gear and rotatable about an axis parallel said gear axis of rotation at said hinged connection between open and closed positions, said arcuate segment in the closed position abuttingly contacting the remaining portion of said last gear, said abutting contact occurring remote said hinge connection, to complete the circular periphery of said last gear and in the open position leaving a gap in the gear periphery for passage of said workpiece between said tip portions of said plates and through said gap into said passageway means of said last gear.

12. A reversible tool for transferring torque from a driving member to a workpiece said driving member and said workpiece rotating in the same direction, comprising:

a. an odd numbered plurality of serially engaging gears rotatable about parallel axes, each of said gears including coaxial cylindrical shoulders extending outwardly from opposite sides thereof;

b. a first gear of said plurality including engagement means coaxial therewith and matingly engagable with said driving member for driving rotation of said first gear thereby;

c. a last gear of said plurality including hexagonal passageway means coaxial therewith and extending entirely therethrough, said passageway means having an inscribed circle of radius smaller than the cylindrical shoulder of said last gear, for engaging said workpiece for rotation thereof by said last gear;

d. stationary side plates sandwiching said plurality therebetween and including cylindrical recesses defining bearing surfaces in respective facing surfaces of said plates, said bearing surfaces being journaled against respective circular facing surfaces of said cylindrical shoulders of said gears other than said last gear for running contact therewith during gear rotation, said recesses having depth less than thickness of said plates so that outwardly facing surfaces of said plates present smooth faces overlying said gears other than said last gear, said sideplates having rounded ends overlying said first gear of said plurality, said rounded ends formed on a radius slightly larger than radius of said first gear of said plurality, said rounded ends being tangent to straight sides of said plates so that all of said gears but said last gear are within an envelope defined by parallel peripheries of said side plates, at least one of said plates including an opening overlying said first gear for passage therethrough of said driving member for engagement with said first gear, said side plates at the ends thereof overlying said last gear having tip portions defining an open end of of said tool, permitting said passageway means of said last gear to engage an axially elongated workpiece by movement of said tool into position around said workpiece in a direction perpendicular to the axis of rotation of said last gear so that said workpiece passes through space separating said tip portions, wherein an imaginary line drawn between said tip portions of said respective side plates is outboard of the axis of rotation of said last gear, side plates in the areas of said tip portions having frustro-cylindrical recesses therein subtending circular arcs of greater than 180° but less than 240° defining bearing surfaces journaled against respective outwardly facing circular surfaces of said shoulders of said last gear, openings in said side plates overlying said last gear and defining said open end of said tool having respective inscribed circles of radius smaller than radius of said frusto-cylindrical recesses for said shoulders of said last gear formed in said side plates but larger than radius of said inscribed circle of said passageway through said last gear centers of said respective circles being coincident with the axis of rotation of said last gear; and e. means, passing through the center gear of said odd numbered plurality, for connecting said side plates together thereby urging said respective bearing surfaces against said facing surfaces of said gears;

f. said last gear including an arcuate segment subtending an arc of 120° with segment and defined by bisections of interior angles of said hexagonal passageway so that two adjoining sides of said hexagon are defined by the interior of said arcuate segment, hingedly connected to the remainder of said last gear and rotatable about an axis parallel said gear axis of rotation at said hinged connection between open and closed positions, abuttingly contacting the remaining portion of said last gear, said abutting contacting the remaining portion of said last gear, said abutting contacting occurring remote said hinge connection of said last gear and in the open position leaving a gap in the gear periphery for passage of said workpiece between said tip portions of said side plates and through said gap into said passageway means of said last gear.

* * * * *